US009132328B1

(12) United States Patent
Daole

(10) Patent No.: US 9,132,328 B1
(45) Date of Patent: Sep. 15, 2015

(54) SHUTTLECOCK TYPE GAME DEVICE

(71) Applicant: Long Daole, Anaheim, CA (US)

(72) Inventor: Long Daole, Anaheim, CA (US)

( * ) Notice: Subject to any disclaimer, the term of this patent is extended or adjusted under 35 U.S.C. 154(b) by 0 days.

(21) Appl. No.: 14/120,989

(22) Filed: Jul. 18, 2014

(51) Int. Cl.
*A63B 67/18* (2006.01)

(52) U.S. Cl.
CPC ..... *A63B 67/18* (2013.01)

(58) Field of Classification Search
CPC ..... A63B 67/18
See application file for complete search history.

(56) References Cited

U.S. PATENT DOCUMENTS

| | | | | | |
|---|---|---|---|---|---|
| 1,011,856 | A | | 12/1911 | Sadler | |
| 2,338,274 | A | | 2/1941 | Yancey | |
| 2,485,420 | A | * | 10/1949 | Timpe | 473/580 |
| 2,613,935 | A | | 10/1952 | Richards | |
| 2,666,643 | A | * | 1/1954 | Miller | 473/580 |
| 2,860,879 | A | * | 11/1958 | Carlton | 473/579 |
| 3,089,704 | A | * | 5/1963 | Wolf | 473/579 |
| 3,560,128 | A | * | 2/1971 | Carlton | 473/579 |
| 3,831,943 | A | | 8/1974 | Popplewell | |
| 4,101,128 | A | | 7/1978 | Yellen | |
| 4,538,818 | A | | 9/1985 | Sinclair | |
| 4,657,262 | A | * | 4/1987 | Buckland | 473/580 |
| 5,924,943 | A | | 7/1999 | Sklar | |
| 6,315,687 | B1 | | 11/2001 | Todd | |
| 6,709,353 | B1 | | 3/2004 | Peterson | |
| 7,258,635 | B2 | | 8/2007 | Brandes | |
| 8,348,790 | B2 | | 1/2013 | York | |
| 2006/0199683 | A1 | | 9/2006 | Brandes | |

FOREIGN PATENT DOCUMENTS

| | | |
|---|---|---|
| CN | 1586682 | 3/2005 |
| WO | WO 2009/048229 | 4/2009 |

* cited by examiner

*Primary Examiner* — John Ricci
(74) *Attorney, Agent, or Firm* — Dennis W. Beech

(57) ABSTRACT

The device is for play of games that use rackets or paddles with handles to propel objects between two or more players. A skirt is attached to a nose. The nose may have a tip formed of a hard synthetic material with a springy, elastic quality, and the tip may have a generally curved front surface and a back surface attached to a body. The body may be a generally solid cylinder shape formed of a cork like consistency material and be formed with an insert of hollow cylindrical form positioned in the center of the material about a central axis. The skirt may have at least three panels formed of a plastic material attached at adjacent edges to form a truncated polyhedron with a base edge shaped as a polygon and a truncated top edge attached to the nose.

10 Claims, 3 Drawing Sheets

SHUTTLECOCK TYPE GAME DEVICE

BACKGROUND OF THE INVENTION

This invention relates to devices for play of games resembling badminton, tennis and other open field games involving two or more players using rackets or paddles with handles to hit an object as for example a shuttlecock or ball. The new shuttlecock device has a weighted, strengthened nose with a plastic skirt attached for a combination device to travel the approximate distance of a standard tennis court when struck or hit by a racket.

Various devices that are similar to badminton shuttlecocks may be known for being modified for game play that involves the shuttlecock to travel a greater distance than would a standard badminton shuttlecock. The modifications may include modifying the shape and structure of the nose portion of the shuttlecock to resemble the size of a tennis ball or a baseball and to add weighted material to the nose. The shape of the nose portion may also be modified to resemble the nose of a missile rather than as a rounded nose. The skirt portion of a shuttlecock type device may also be known for modifications such as use of plastic individual vanes rather than the use of feathers. Also skirts formed of continuous plastic material formed in a truncated cone shape with perforations in the plastic may have been used for the skirt portion. The continuous plastic material skirts may have been shaped with a portion that has an undulating form to impart spin to the shuttlecock in travel through air.

SUMMARY OF THE INVENTION

The present invention is directed to devices for play of games that use rackets or paddles with handles to propel objects between two or more players. A skirt is attached to a nose. The nose may have a tip formed of a hard synthetic material with a springy, elastic quality, and the tip may have a generally curved front surface and a back surface attached to a body. The body may be a generally solid cylinder shape formed of a cork like consistency material and be formed with an insert of hollow cylindrical form positioned in the center of the material about a central axis. The skirt may have at least three panels formed of a plastic material attached at adjacent edges to form a truncated polyhedron with a base edge shaped as a polygon and a truncated top edge attached to the nose.

These and other features, aspects and advantages of the present invention will become better understood with reference to the following drawings, description and claims.

DETAILED DESCRIPTION

The following detailed description represents the best currently contemplated modes for carrying out the invention.

The description is not to be taken in a limiting sense, but is made merely for the purpose of illustrating the general principles of the invention.

Figure 1:
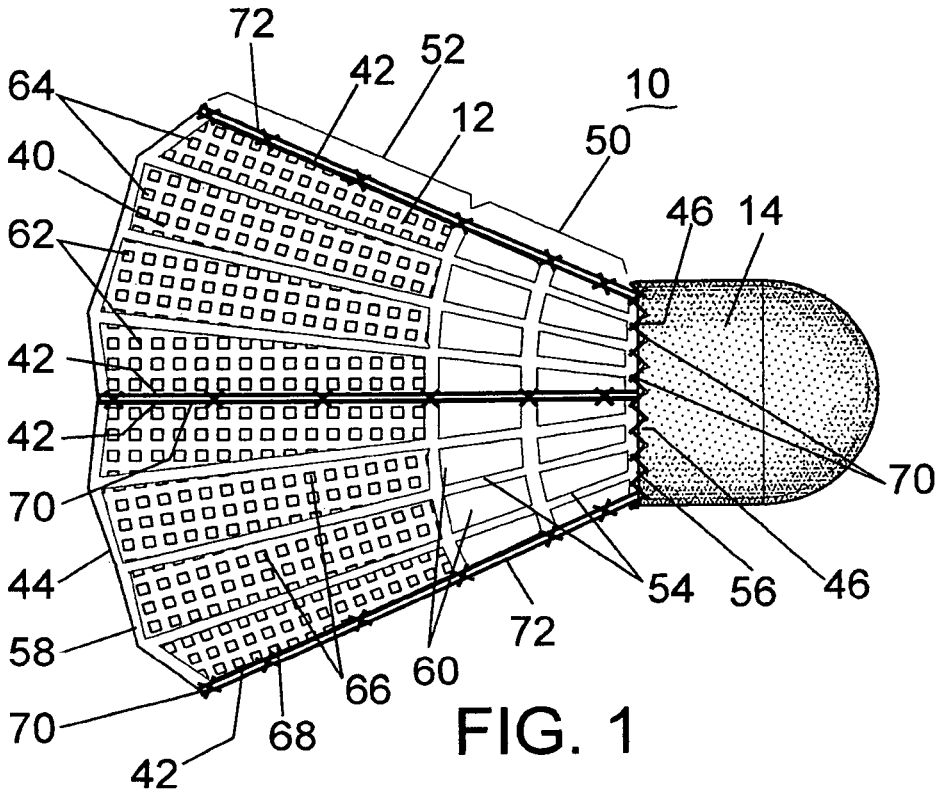
FIG. 1 illustrates a side view of a shuttlecock according to an embodiment of the invention.
Figure 2:
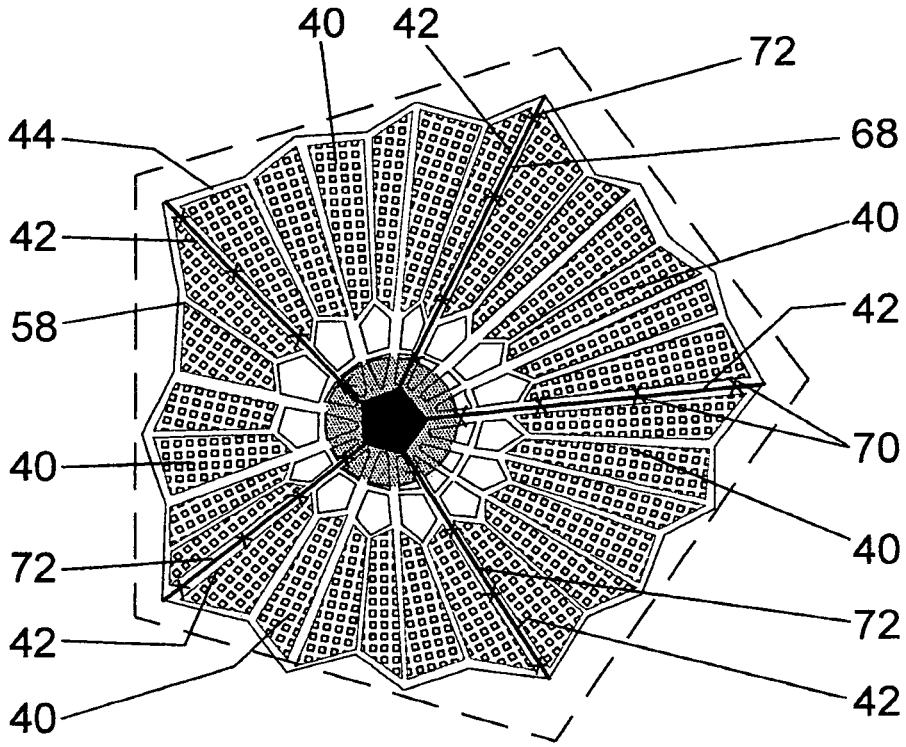
FIG. 2 illustrates a perspective view of a shuttlecock according to and embodiment of the invention.
Figure 3:
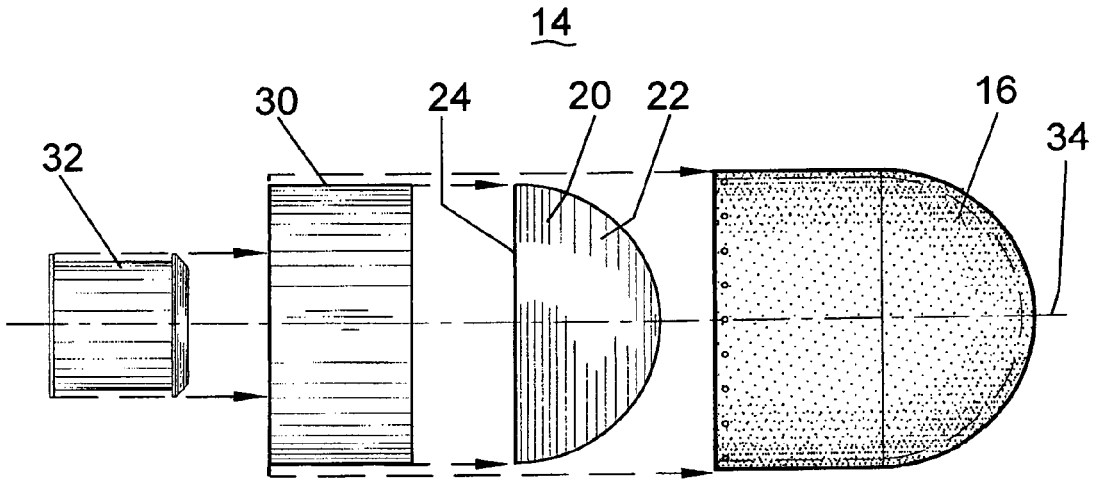
FIG. 3 illustrates an exploded view of a nose portion of a shuttlecock without a cover according to an embodiment of the invention.
Figure 4:
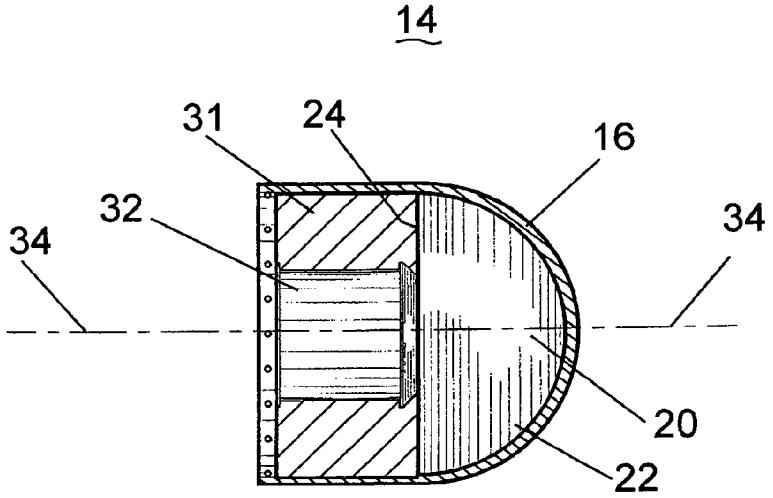
FIG. 4 illustrates a perspective partial cut away view of a nose portion of a shuttlecock according to an embodiment of the invention.
Figure 5:
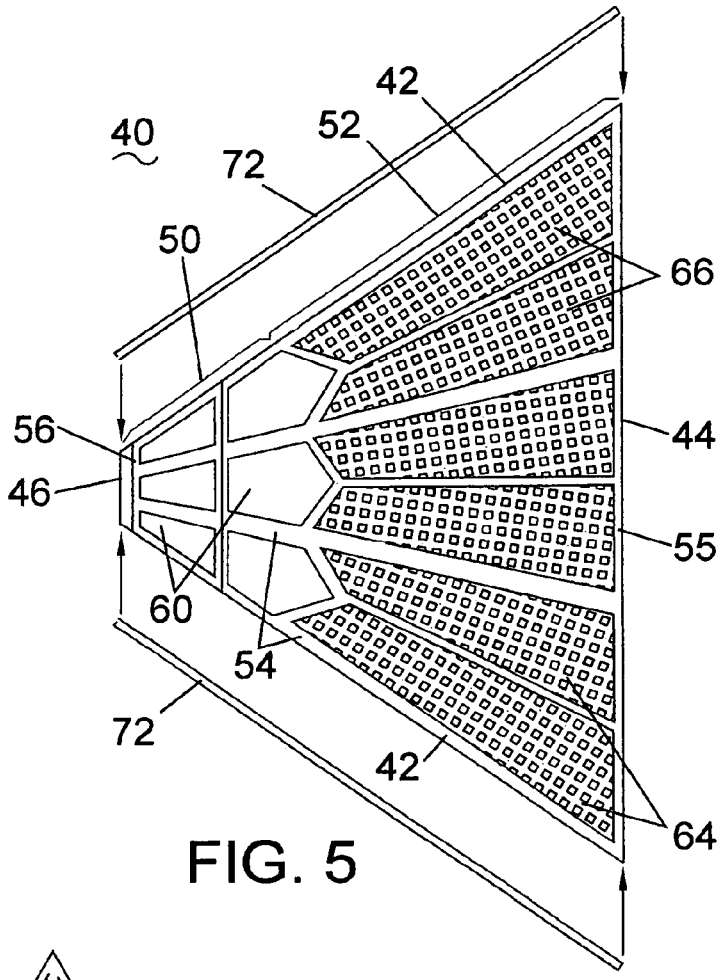
FIG. 5 illustrates a plan view of a skirt panel according to an embodiment of the invention.
Figure 6:
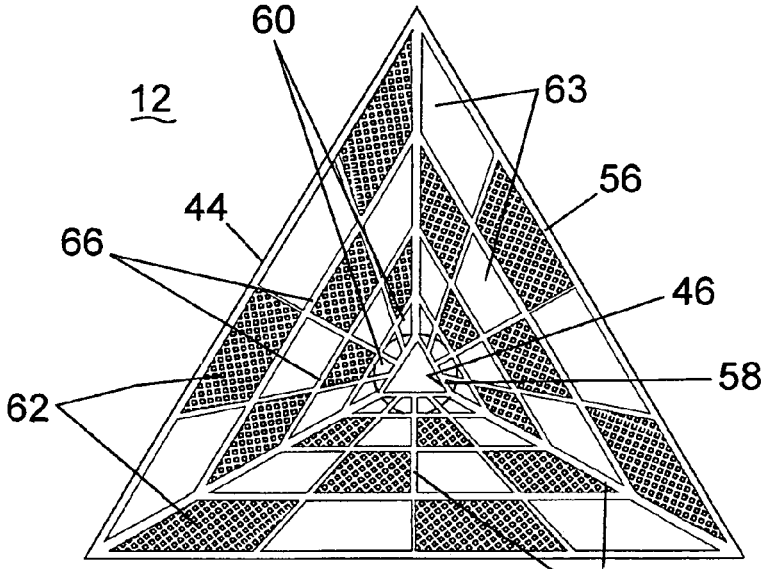
FIG. 6 illustrates a perspective view of a shuttlecock according to an embodiment of the invention.

Referring to FIGS. 1 through 6, a shuttlecock type game device 10 has a skirt 12 attached to a nose 14. The nose 14 has a tip 20 attached to a body 30. The tip 20 may have a generally round curved front surface 22 and is bonded at a back surface 24 to the body 30. The body 30 is generally a solid cylinder in shape and may be formed of a cork material. A hollow cylindrical insert 32 may be positioned in the body 30 material centered about the central axis 34 of the body 30.

A cover 36 may be positioned over the nose 14. The cover 16 may be formed of a thin, flexible and resilient material, as for example a synthetic polyamide material that is durable and strong to serve as the protective cover of the nose 14. In use the nose 14 of the shuttlecock 10 will be struck by rackets or the like, and in general may impact hard surfaces or other a structures.

The tip 20 may be formed of relatively hard rubber or synthetic material with a springy, elastic quality and durable, resilient material structure. The combination of the tip 20 and body 30 with a structural plastic insert 32 should weigh approximately 0.30 to 0.40 ounces and have a spring quality that if dropped on a hard surface it will rebound or bounce to the approximate height of the upper torso of a person. This will allow during play of a game for a player to have a chance to hit a shuttlecock that bounces, i.e., a second chance if the shuttlecock is missed while in flight. The bounce height would apply if the nose 14 has a cover 16.

The skirt 12 is formed of multiple sections or panels 40 of plastic material that are attached at adjacent edges 42 to form a truncated polyhedron with a base edge 44 of a polygon that may be three sided or five sided. The truncated top edge 46 is attached to the nose 14.

The panels 40 may have an upper portion 50 and a lower portion 52. The panels 40 may have spaced apart, diverging stems 54 that extend from a top band 56 at the top edge 46 to a bottom band 58 at the base edge 44. The upper portion 50 will have relatively large voids 60 in between the stems 54, as best viewed in FIG. 5. The lower portion 52 may have strands 64 generally parallel to the stems 54 and spaced apart between the stems 54, and ribs 66 formed generally orthogonal to the stems 54 and strands 64 to form a mesh 10, structure with small voids 62. It has been found by experiment that panels 40 formed of flexible, sheet plastic material or the like when attached to form a skirt 12 allows good flight characteristics and durability.

The lower portion 52 may also have additional voids 63 that are generally sized smaller than the large voids 60. The voids 63 may be formed in the material formed in the lower portion 52 between the stems 54 that is the strands 64 and ribs 66, see FIG. 6. These additional voids 63 have been found by experiment to reduce the effect of cross wind, side wind or lateral wind relative to the direction of flight. This improves shuttlecock 10 flight distance and direction accuracy when playing outdoors in windy conditions.

The skirt 12 is assembled by attaching three or more panels 40 at adjacent edges 42. Experiments have found that good shuttlecock 10 flight characteristics occur with three or five panels 40 used to form the skirt 12. Individual panels 40 may be formed with creases formed in the mesh portion of the lower portion 52 to further change the flight characteristics of the shuttlecock 10. The speed of flight of a shuttlecock 10 with nose 14 and a truncated polyhedron shaped skirt 12 has been found to be faster than a tennis ball when hit by a racket, to be more accurate in direction and flight, and to travel farther.

The panels 40 may be attached at adjacent edges 42 by stitching with thread 70 that may be any suitable material such as textile fabric, nylon, plastic and the like. The assembled skirt 12 may be attached to the nose 14 by stitching to the cover 16 portion over the nose 14. The attachment at the adjacent edges 42 may include insertion of flexible, resilient rods 72 positioned parallel to adjacent edges 42, and narrow strips 68 of sheet material similar to that of the panel 40 material all to be stitched in place along the adjacent edges 42 of the panels 40. This structure may increase structural strength and durability of the skirt 12 and its shape to resist deformation or damage that might be caused by impacts in game play use. The game play may be on a court such as a tennis court or other venue such as grass and does not require a court with marked lines. The players may be spaced apart a distance of up to 60 feet to 70 feet. The structure of the shuttlecock 10 allows increased bounce, protection of rackets used in games with cover 16, and game play at increased distance between players.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for shuttlecock like game play, comprising:

a skirt attached to a nose;

wherein said nose has a tip formed of a hard synthetic material with a springy, elastic quality, and said tip has a generally curved front surface and a back surface attached to a body;

wherein said body is generally a solid cylinder shape formed of a cork like consistency material and formed with an insert of hollow cylindrical form disposed in the center of said material about a central axis; and wherein said skirt has at least three panels formed of a plastic material attached at adjacent edges to form a truncated polyhedron with a base edge shaped as a polygon and a truncated top edge attached to said nose.

2. The device as in claim 1 wherein a cover formed of a thin, flexible and resilient material is disposed on said nose and said skirt at said truncated top edge is attached to said cover.

3. The device as in claim 2 wherein said skirt is attached to said cover by stitching with thread.

4. The device as in claim 1 wherein said skirt is a three sided truncated polyhedron.

5. The device as in claim 1 wherein said skirt is a five sided truncated polyhedron.

6. The device as in claim 1 wherein said skirt with said panels, comprising:

an upper portion adjacent said truncated top edge with a plurality of stems that are spaced apart and diverging to extend from a top band at said truncated top edge to a bottom band at said base edge wherein said upper portion having a plurality of large voids formed between said stems; and a lower portion with a plurality of strands disposed generally parallel and spaced apart between said stems, and a plurality of ribs disposed generally orthogonal to said stems and said strands to form a mesh structure having a plurality of small void formed therein.

7. The device as in claim 6 wherein said lower portion has a plurality of voids formed between said stems by removal of a portion of said strands and said ribs.

8. The device as in claim 1 wherein said panels are formed of a flexible, sheet plastic material.

9. The device as in claim 1 wherein said at least three panels are attached at adjacent edges by stitching with thread.

10. The device as in claim 9 wherein said at least three panels are attached at adjacent edges with a rod positioned adjacent and parallel to said adjacent edges with a narrow strip of material disposed over said rod for stitching with thread at said adjacent edges.

* * * * *